US006367670B1

(12) United States Patent
Warner et al.

(10) Patent No.: US 6,367,670 B1
(45) Date of Patent: Apr. 9, 2002

(54) CONTAINER CAP HAVING INTEGRAL POUR SPOUT

(75) Inventors: Jim F. Warner, Hoboken; Robert J. Croft, Jersey City, both of NJ (US); Martin Short; Insun Yun, both of New York, NY (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/543,581

(22) Filed: Apr. 5, 2000

(51) Int. Cl.[7] ..... B65D 47/00
(52) U.S. Cl. ..... 222/556; 222/571
(58) Field of Search ..... 222/556, 566, 222/571

(56) References Cited

U.S. PATENT DOCUMENTS 3,142,422 A * 7/1964 Mojonnier ..... 222/566
4,591,078 A * 5/1986 Weissman ..... 222/571
4,890,770 A * 1/1990 Haga et al. ..... 222/571
5,657,802 A * 8/1997 Kim ..... 222/556

FOREIGN PATENT DOCUMENTS

CA 597258 * 5/1960 ..... 222/571

* cited by examiner

*Primary Examiner*—Joseph A. Kaufman

(57) ABSTRACT

A container cap for attachment to the threaded neck of a container from which a liquid is to be dispensed, which includes a base portion having a circular upper face and a depending skirt, with the skirt being threaded on an interior surface to lockingly engage the container neck. The upper face of the container has a triangular-shaped opening extending therethrough with an integral upstanding pour spout extending around the perimeter of the pour spout. The sidewalls of the pour spout converge toward one edge of the upper face and are joined by a curve of small radius to form a tip, with the other end of the sidewalls being joined by a curve of substantially larger radius. The upper ends of the sidewalls are curved outwardly and have an outwardly extending rib at the tip portion of the pour spout. The geometry of the pour spout provides a container cap from which liquid may be discharged in a smooth flow with no pulsation, with a high degree of controllability while avoiding undesirable dripping of liquid when the container is returned to an upright position.

9 Claims, 3 Drawing Sheets

CONTAINER CAP HAVING INTEGRAL POUR SPOUT

BACKGROUND OF THE INVENTION

This invention relates to a cap for containers intended to dispense liquids by pouring. More particularly, the invention relates to a pour spout for a liquid container cap, which is effective in controlling the flow of liquid from the container.

In pouring a liquid, such as milk, coffee whitener, salad dressing, syrup, sauces, detergent, shampoo and the like, from a container, it is often difficult to control the flow of liquid from the container. For example, liquid containers usually are provided with a pour spout, with the container normally being tilted to discharge the liquid from the container through the pour spout. Typically, when the container is returned to an upright position, a portion of the liquid tends to follow the outer surface of the pour spout and drips down the outer side of the pour spout and the container, resulting in the accumulation of undesirable, sticky deposits on outside container surfaces. Also, depending on the size and shape of the pour spout, when the container is tilted to dispense the liquid, the flow of air into the container may be interrupted by the flow of liquid out of the container, resulting in a pulsating flow of liquid from the container, rather than a smooth flow. A number of proposals have been made in the prior art to eliminate these problems, but such prior proposals have one or more disadvantages has prevented their acceptance on a commercial scale.

SUMMARY OF THE INVENTION

The present invention provides a cap for a container from which liquid is to be dispensed by pouring, with the cap having an integral pour spout which is constructed and configured to provide control of the flow of liquid from the container, provide a smooth flow of liquid from the container, and to prevent undesirable dripping of the liquid on the outside of the container when the pouring operation is completed.

The cap of this invention includes a base member which preferably is threaded onto the neck of the container, and a cover hingedly secured to one edge of the base member. The upper surface of the base member is provided with an elongated triangular-shaped opening, narrow at one end and wider at the opposing end. The wider end or base of the opening is adjacent the edge of the base member at which the cover is secured, and the narrow end or tip of the opening is adjacent the edge of the base member opposite the cover hinge. An integral pour spout projects upwardly from the upper surface of the base member around the periphery of the triangular opening. The sidewalls of the pour spout converge toward the tip of the triangular-shaped opening, and are joined together in an apex or rounded junction formed by a curve of small radius. The other end of the sidewalls are joined together adjacent the cover hinge, in a rounded junction having a radius of curvature substantially larger than the radius at the tip end of the pour spout. The upper end of the sidewalls of the pour spout are curved outwardly, with the sidewalls having an outwardly extending rib at and adjacent to the tip portion. In a preferred embodiment, the sidewalls of the pour spout slope upwardly from the base of the pour spout toward the tip, to provide a pouring tip which further facilitates control of the liquid being poured from the container.

The geometry of the pour spout, specifically the combination of the converging sidewalls, the small radius of curvature joining the converging sidewalls to define a narrow tip, the larger radius of curvature joining the diverging sidewalls, the upwardly sloping sidewalls, and the smooth outward curvature and inclusion of the outwardly extending rib at the upper edge of the sidewalls, all contribute to provide a container cap from which liquid may be discharged in a smooth flow, with a high degree of controllability, while avoiding undesirable dripping of liquid when the container is returned to an upright position.

DESCRIPTION OF THE INVENTION

Figure 2:
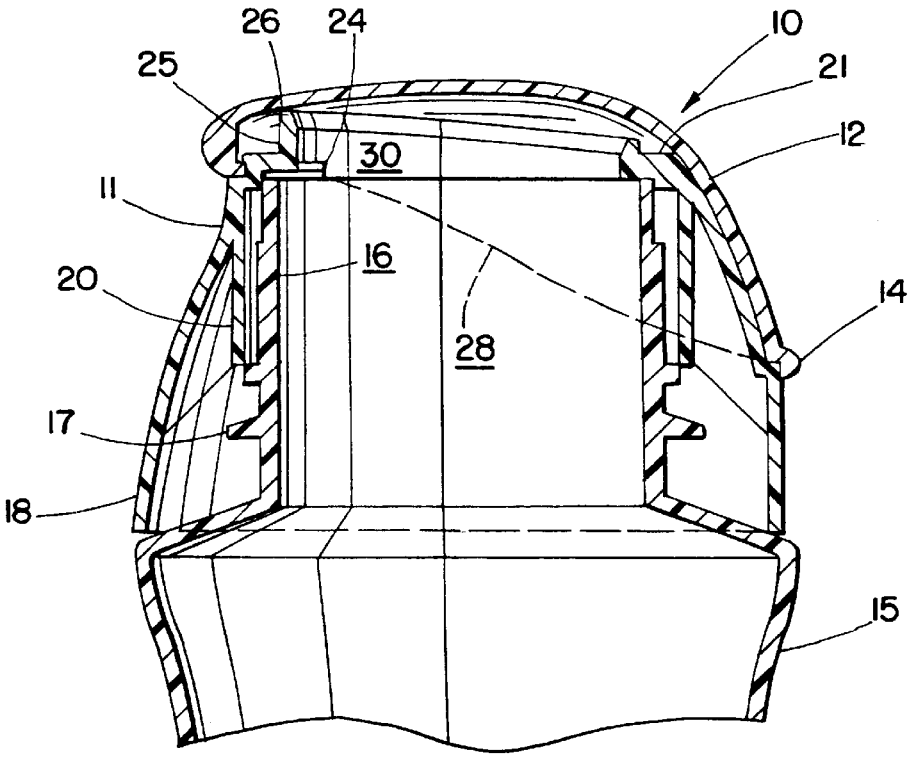
FIG. 2 is a vertical cross-sectional view of the container cap mounted on the neck of a container.

Like reference numerals will be used to refer to like or similar parts from Figure to Figure in the following description of the invention.

Referring to the drawings, the container cap 10 of this invention includes a base member 11 and a cover 12 which extends over the base member and is attached to one side of the base member by means of an integral flexible hinge 14. As shown in FIG. 2, the container cap 10 is adapted to be mounted on the upper end of a bottle 15 holding the liquid to be dispensed, with the cap extending over the mouth 16 the bottle. The base member 11 of the cap is fashioned with a planar upper face 21 and an outwardly curved skirt 18 depending downwardly from the outer edge of planar face 21. Internal threading is provided at the base of the skirt 18 for cooperative engagement with external threads or ribs 17 on the neck of the bottle adjacent the mouth, to secure the cap on the bottle. An inner annular flange 20, which is coaxial with the skirt 18, projects downwardly from the planar upper face 21 within the inner surface of pendant skirt 18 and is adapted to fit around the neck of the bottle.

Figure 1:
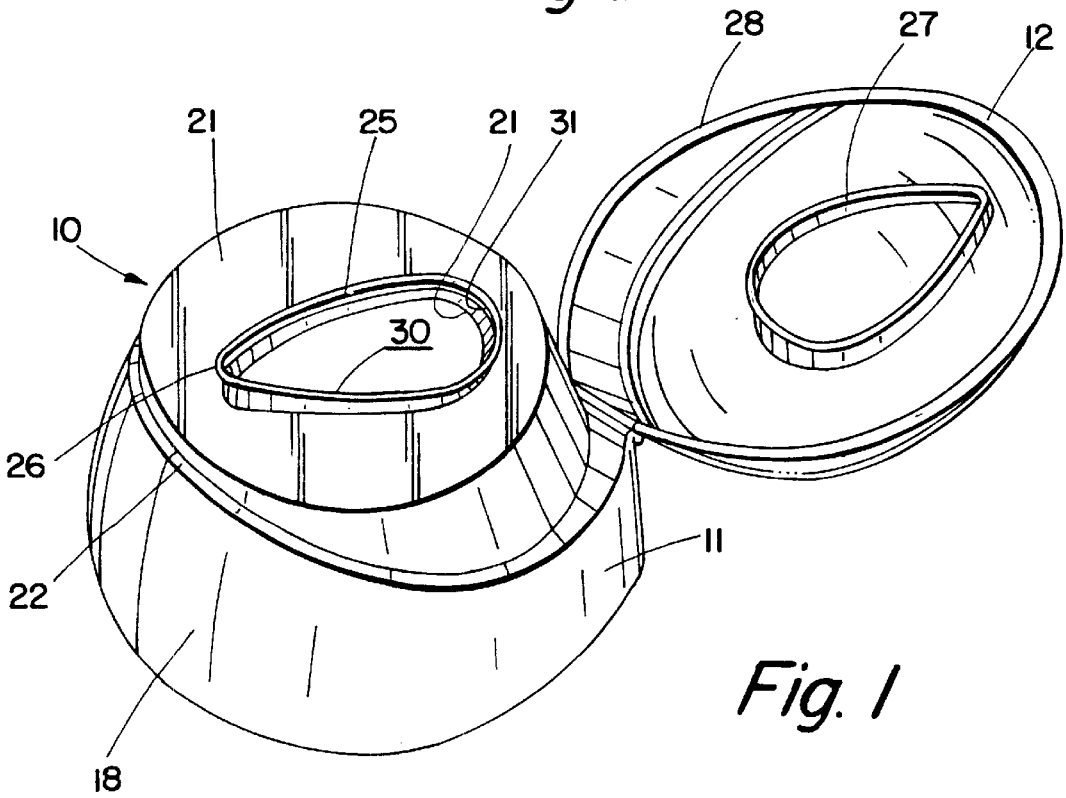
FIG. 1 is a perspective view of the container cap of this invention with the cover in an open position.
Figure 3:
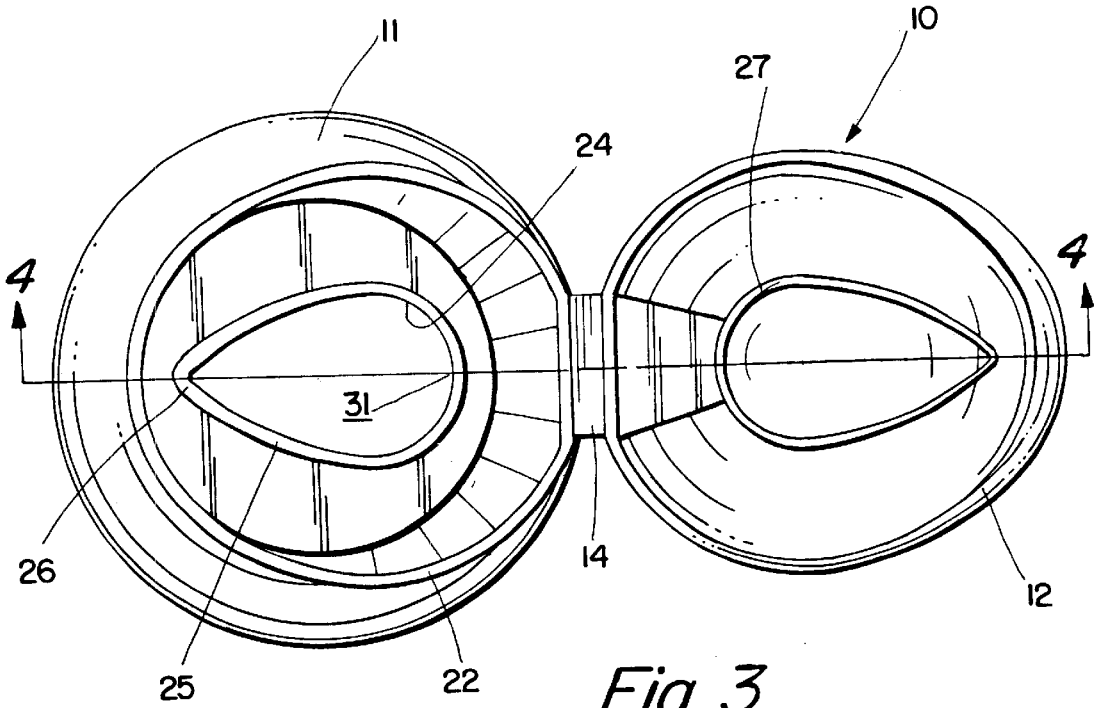
FIG. 3 is a plan view of the container cap showing the cover in an open position.

A curvilinear annular shoulder 22 extends around the perimeter of the base member from a point adjacent the upper face 21 to a point intermediate the upper face and the bottom edge of the base member. As shown in FIG. 1, annular shoulder 22 is proximate upper face 21 of the base member 11 at the side of the base member opposite the hinge 14, and is most remote from the upper face at the side of the base member adjacent the flexible hinge 14. An elongated triangular-shaped opening 24 extends through the upper face 21 of the base member through which liquid from the bottle is poured, with the opening being aligned so that the base or broader end of the opening is adjacent the hinge 14. An integral pour spout 25 projects upwardly from the upper face 21 of the base member around the perimeter of the triangular-shaped opening 24, with the configuration of the pour spout 25 conforming to the configuration of triangular-shaped opening 24.

The cover 12, which extends over the base member when it is in its closed position, is attached at one side of the base member 11 at the annular shoulder 22 by means of integral flexible hinge 14. The inner surface of cover 12 is provided with an integral triangular-shaped rim portion 27 which fits snugly into pour spout 25 to seal the pour spout when the cover is moved to a closed position. The length of the hinge 14 is such that the rim portion 27 will always be properly seated in the opening of the pour spout 25 as the cover 12 is pivoted into its closed position. The bottom edge 28 of the cover has a curvilinear configuration which corresponds to the configuration of the annular shoulder 22 of the base member, so that the cover fits snugly on the base member when it is closed.

Figure 5:
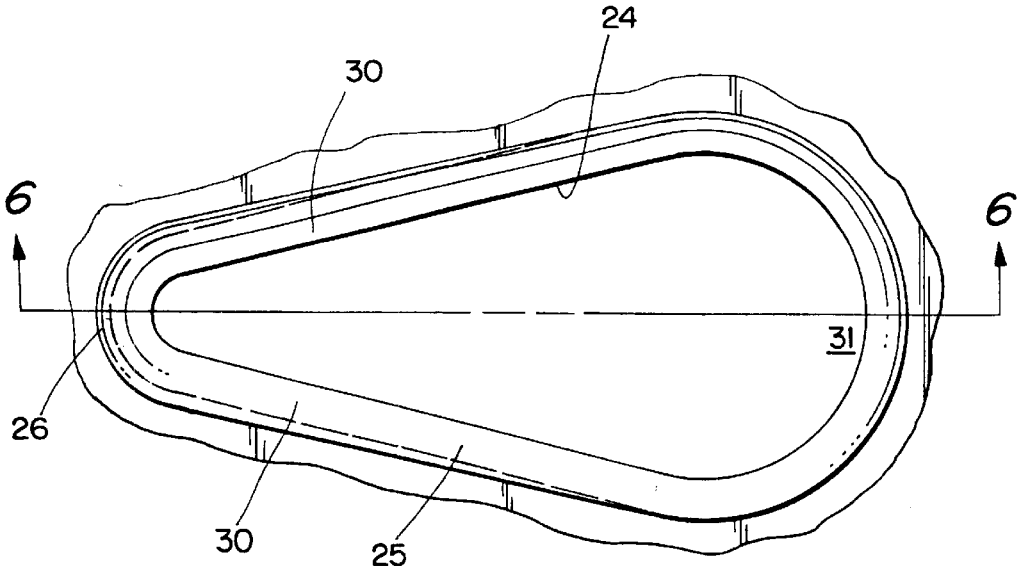
FIG. 5 is an enlarged plan view of the pour spout on the container cap.

As best shown in FIG. 5, the sidewalls 30 of the pour spout 25 converge in a direction away from the integral hinge 14, and are joined together near the edge of planar upper face 21 in a rounded junction formed by a curve of small radius to form the tip 26 of the pour spout. Typically, the subtended angle between the converging sidewalls in the forward area of the pour spout, i.e., between the midpoint and the tip of the pour spout, is between about 20 degrees and 40 degrees, preferably between 25 and 35 degrees. At the opposite end of the pour spout 25 the diverging sidewalls are joined together in a rounded junction to form the base 31 of the pour spout, with the junction of the diverging sidewalls having a larger radius of curvature than at the tip end of the pour spout. In accordance with a preferred embodiment of the invention, the radius of curvature of the junction of the diverging sidewalls at the base 31 of the pour spout is about 3 to 5 times greater than the radius of curvature of the junction of the converging sidewalls at the tip 26 of the pour spout. Preferably, the area defined by the radius of curvature at the base 31 of the pour spout 25 and opening 24 is about 15 to 20 times greater than the area defined by the radius of curvature at the tip 26 of the pour spout 25 and opening 24.

The configuration of the converging sidewalls 30 of the pour spout to define an opening of relatively narrow width at the tip end 26 of the pour spout provides high controllability of liquid flow from the bottle, and enables the user to accurately control the flow of liquid. That is, the distance between the converging sidewalls at the tip of the pour spout from which liquid is poured, is sufficiently narrow so that the sidewalls exert sufficient interfacial surface tension between the walls and the liquid being poured to promptly terminate the flow of liquid from the bottle when the bottle is returned to an upright position. Since the area of the triangular-shaped opening 24 and the pour spout is significantly greater at the base 31 than at the tip end 26, pulsation of liquid poured from the bottle is eliminated and a smooth flow of liquid is provided when the bottle is tilted. That is, because of the increased size of the air admitting area at the base 31 of the pour spout, air may flow unimpeded into the bottle as the liquid is dispensed, to prevent formation of a vacuum in the bottle and provide for the smooth flow of liquid and avoid any pulsation in the liquid stream being poured.

Figure 4:
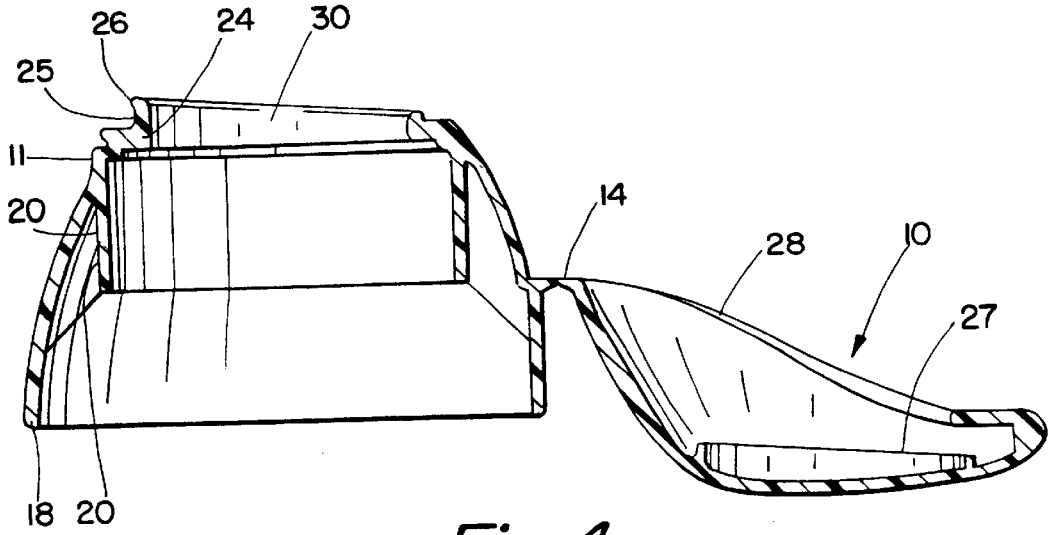
FIG. 4 is a sectional view of the container cap with the cover in an open position, taken along line 4—4 of FIG. 3.
Figure 6:
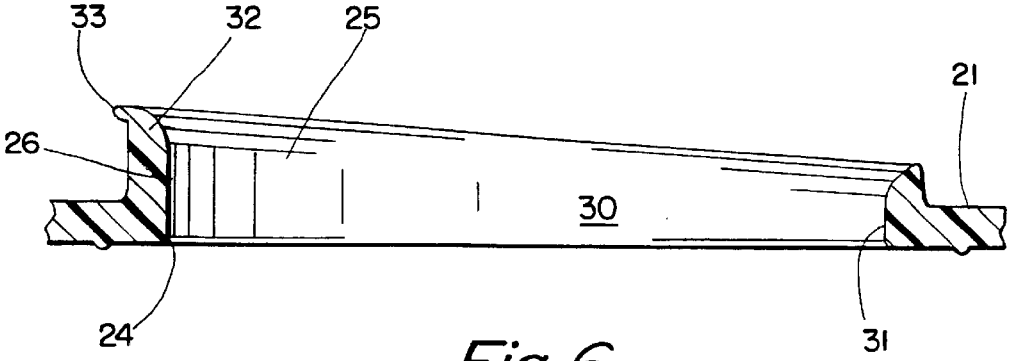
FIG. 6 is a sectional view of the pour spout along lines 6—6 of FIG. 5.

As shown in FIGS. 4 and 6, the walls of the pour spout slope upwardly from the base 31 toward the narrow end or tip 26 of the pour spout to provide a pouring tip. Preferably, the height of the sidewall at the tip 26 of the pour spout is on the order of about 2 to 3 times greater than the sidewall height at the base 31 of the pour spout. This upward slope of the pour spout sidewalls further facilitates control of the flow of liquid from the bottle.

As shown in FIG. 6, the generally vertical sidewalls 30 of the pour spout are curved outwardly 32 at the upper end of the sidewalls, and an integral outwardly projecting rib 33 is provided on the outer surface of the sidewall at the top edge thereof. The rib 33 extends from the proximate midpoint of a pour spout sidewall, around the tip 26 of the pour spout, to the proximate midpoint of the opposing sidewall. The smooth curve 32 at the upper end of the pour spout sidewalls, in combination with the outwardly projecting rib, cooperate to cleanly terminate the liquid stream being poured while preventing dripping of the liquid down the exterior of the cap and bottle.

The container cap of this invention is preferably made of a thermoplastic resinous material such as for example polyethylene, polypropylene or acrylonitrile-butadiene-styrene copolymers, such that the container cap can be fabricated as a unitary part. However, the cap may, if desired, be made from other equivalent materials.

According to the invention, a pour spout for a liquid container cap has been provided which facilitates accurate control of the liquid being poured, provides a smooth flow of liquid from the bottle, and eliminates dripping of the liquid on the exterior of the bottle when the bottle is returned to an upright position.

What is claimed is:

1. A container cap for attachment to a container having a neck with an exterior threaded surface from which liquid is to be dispensed, which comprises a base member adapted to be threadably secured to the container neck, and a cover which is hingedly secured to said base member and is sized to fit over the base member when in a closed position, said base member having a planar upper face with a peripheral skirt portion depending downwardly from the outer edge of the planar face, and an inner annular flange extending downwardly from said planar upper face and being sized to fit over the neck of the container, the planar upper face of said base member having a triangular-shaped opening extending therethrough and a pour spout extending upwardly from the upper surface of said planar face around the perimeter of the triangular-shaped opening, said pour spout having sidewalls which converge toward one edge of the planar upper face of the base member and are joined by a curve of small radius adjacent said one edge of the planar upper face to form a tip portion of the pour spout, with the sidewalls at the opposing end of the pour spout being joined by a curve having a greater radius than the curve at said tip portion to form a base portion of the pour spout, the upper edge of the pour spout sidewalls being curved outwardly and terminating in an outwardly projecting rib at the upper outer edge of said sidewalls at the tip portion of the pour spout, with the sidewalls of the pour spout sloping upwardly from the base portion of the pour spout to the tip portion thereof.

2. The container cap defined in claim 1 in which the radius of curvature joining the sidewalls of the pour spout at the base portion thereof is about 3 to 5 times greater than the radius of curvature joining the sidewalls at the tip end of the pour spout.

3. The container cap defined in claim 2 in which area defined by the radius of curvature at the base portion of the pour spout is about 15 to 20 times greater than the area defined by the radius of curvature at the tip end of the pour spout.

4. The container cap defined in claim 1 in which the subtended angle between the converging sidewalls at the forward end of the pour spout is between about 20 degrees and 40 degrees.

5. The container cap defined in claim 1 in which the height of the pour spout sidewall at the tip portion thereof is about 2 to 3 times higher than the sidewall height at the base portion of the pour spout.

6. The container cap defined in claim 1 in which the outwardly projecting rib at the upper surface of the pour spout sidewall extends from the proximate midpoint of one of the sidewalls, around the tip portion of the pour spout to the proximate midpoint of the opposing sidewall of the pour spout.

7. The container cap defined in claim 1 in which an upstanding triangular-shaped rim portion is provided on the inner surface of the cover and is sized to frictionally engage the sidewalls of the pour spout to seal the pour spout when the cover is moved to a closed position.

8. The container cap defined in claim 1 in which the base portion of the pour spout is positioned adjacent the edge of the upper planar surface of the base member adjacent the cover hinge, and the tip portion of the pour spout is adjacent the opposing edge of said planar upper surface.

9. A container cap for attachment to a container having a neck with an exterior threaded surface from which liquid is to be dispensed, which comprises a base member adapted to be threadably secured to the container neck, and a cover hingedly secured to said base member and sized to fit over the base member when in a closed position, said base member having a planar upper face with a peripheral skirt portion depending downwardly from the outer edge of the planar face, and an inner annular flange extending downwardly from said planar upper face and being sized to fit over the neck of the container, the planar upper face of said base member having a triangular-shaped opening extending therethrough and a pour spout extending upwardly from the upper surface of said planar face around the perimeter of the triangular-shaped opening, said pour spout having sidewalls which converge toward one edge of the planar upper face of the base member and are joined by a curve of small radius adjacent said one edge of the planar upper face to form a tip portion of the pour spout, with the sidewalls at the opposing end of the pour spout being joined by a curve having a greater radius than the curve at said tip portion to form a base portion of the pour spout, with the radius of curvature at the base portion being about 3 to 5 times greater than the radius of curvature at the tip portion of the pour spout and the subtended angle between the converging sidewalls at the forward end of the pour spout is between about 20 degrees and 40 degrees, the upper edge of the pour spout sidewalls being curved outwardly and terminating in an outwardly projecting rib at the upper outer edge of said sidewalls at the tip portion of the pour spout, with the sidewalls of the pour spout sloping upwardly from the base portion of the pour spout to the tip portion thereof whereby the height of the pour spout sidewall at the tip portion thereof is about 2 to 3 times higher than the sidewall height at the base portion of the pour spout.

* * * * *